US011965717B2

(12) United States Patent
Murray

(10) Patent No.: US 11,965,717 B2
(45) Date of Patent: Apr. 23, 2024

(54) ELECTROMAGNETIC GRENADE

(71) Applicant: Patrick Murray, Clover, SC (US)

(72) Inventor: Patrick Murray, Clover, SC (US)

( * ) Notice: Subject to any disclaimer, the term of this patent is extended or adjusted under 35 U.S.C. 154(b) by 0 days.

(21) Appl. No.: 18/223,951

(22) Filed: Jul. 19, 2023

(65) Prior Publication Data

US 2023/0408228 A1 Dec. 21, 2023

Related U.S. Application Data

(63) Continuation of application No. 17/711,123, filed on Apr. 1, 2022, now abandoned.

(51) Int. Cl.
*F41H 13/00* (2006.01)
*F42B 27/00* (2006.01)

(52) U.S. Cl.
CPC ..... *F41H 13/0093* (2013.01); *F42B 27/00* (2013.01)

(58) Field of Classification Search
CPC ..... F41H 13/0093; F42B 27/00
USPC ..... 102/293
See application file for complete search history.

(56) References Cited

U.S. PATENT DOCUMENTS 8,981,261 B1 * 3/2015 Tillotson ..... F41H 13/0093 219/202
10,088,278 B1 * 10/2018 Tanielian ..... F41H 13/0093
2020/0363167 A1 * 11/2020 Furlong ..... F41H 11/02
2023/0408228 A1 * 12/2023 Murray ..... F42B 27/00

* cited by examiner

*Primary Examiner* — Samir Abdosh
(74) *Attorney, Agent, or Firm* — Jeffrey C. Watson, Esq.; Grell & Watson Patent Attorneys LLC

(57) ABSTRACT

The Electromagnetic Grenade is a destructive device used to disable Unmanned Ground Vehicles (UGV). The Electromagnetic Grenade is a purpose-built shell/round that utilizes an explosively pumped flux compression generator to create an electromagnetic pulse destructive enough to disable or destroy UGVs and similar military equipment which employ electricity as energy for onboard systems. The electromagnetic grenade includes a standard shell casing, a power source, capacitor bank, a solenoid, and a standard fuse. The casing and size of the shell can be changed to suit the weapon system that will employ the Electromagnetic Grenade. The design can be scaled to work with smaller and larger ordinance which will include small arms, artillery shells, bombs, missiles, rockets, sub-munitions, loitering munitions and similar.

20 Claims, 1 Drawing Sheet

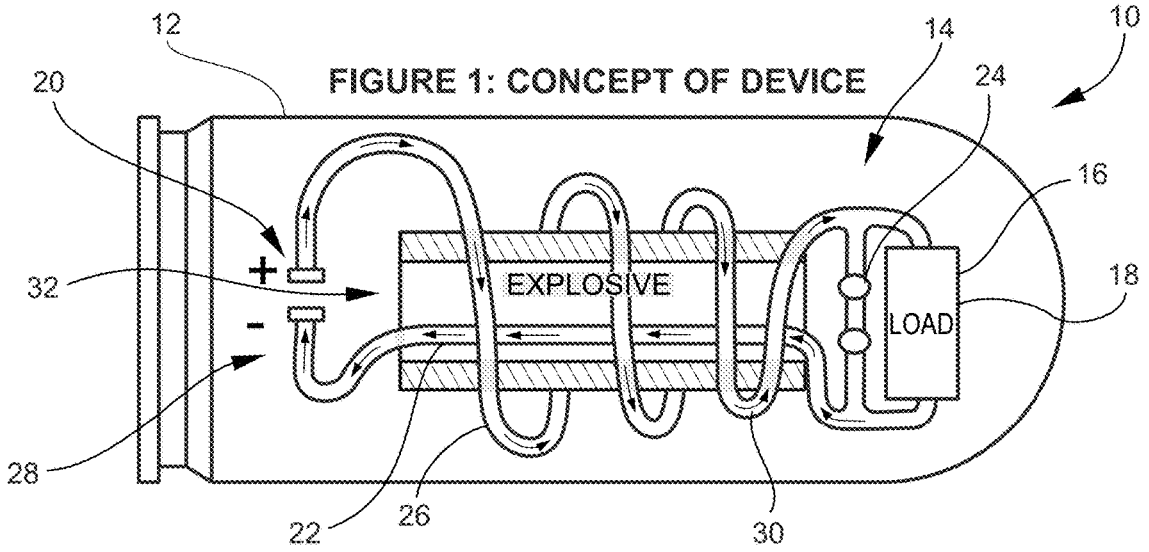
FIGURE 1: CONCEPT OF DEVICE
12
14
10
20
24
16
32
+
EXPLOSIVE
18
-
LOAD
28
22
26
30
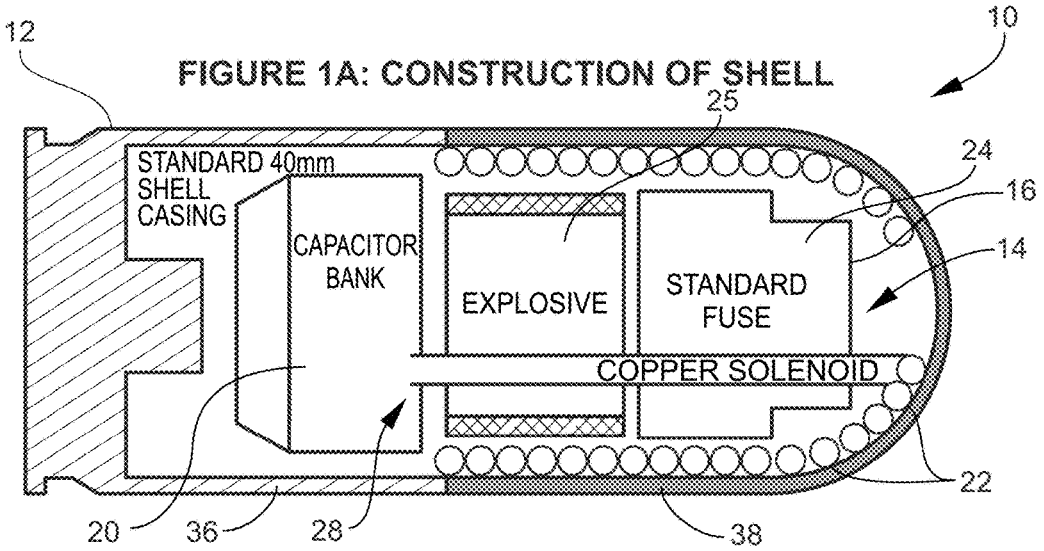
FIGURE 1A: CONSTRUCTION OF SHELL
12
10
25
STANDARD 40mm
SHELL
CASING
24
16
CAPACITOR
BANK
14
EXPLOSIVE
STANDARD
FUSE
COPPER SOLENOID
22
20
36
28
38
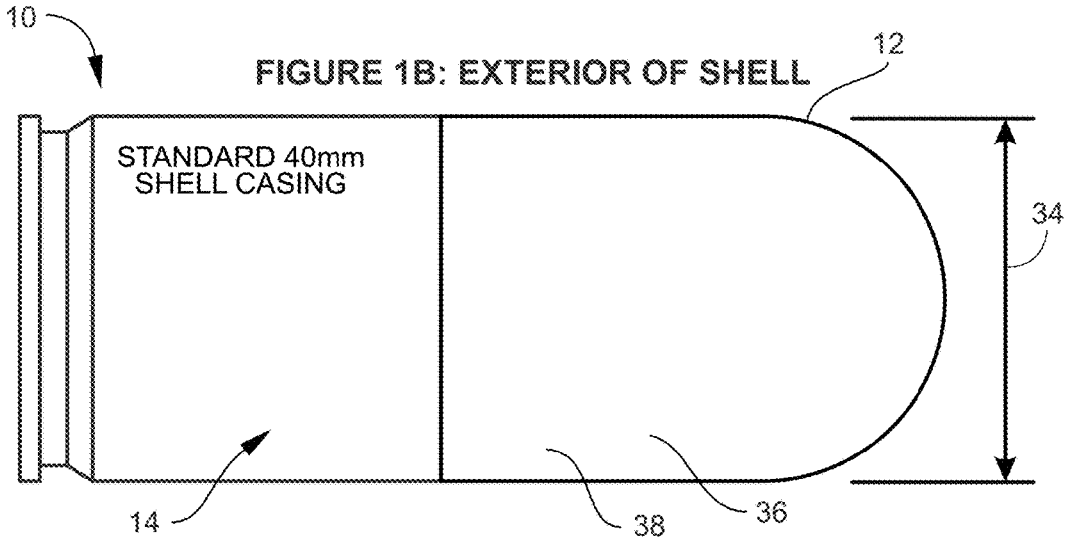
10
FIGURE 1B: EXTERIOR OF SHELL
12
STANDARD 40mm
SHELL CASING
34
14
38
36

ELECTROMAGNETIC GRENADE

CROSS-REFERENCE TO RELATED APPLICATIONS

This application is a continuation application of U.S. patent application Ser. No. 17/711,123 entitled "ELECTROMAGNETIC GRENADE" filed on Apr. 1, 2022, which claims benefit to U.S. Provisional Patent Application No. 63/202,163 filed on May 28, 2021, entitled "ELECTROMAGNETIC GRENADE", which are incorporated by reference in their entireties.

FIELD OF THE DISCLOSURE

The present disclosure relates to electromagnetics and grenades. More specifically, the present disclosure relates to an electromagnetic grenade.

BACKGROUND

The Electromagnetic Grenade is designed to be a destructive device used to disable Unmanned Ground Vehicles (UGV) or other military like equipment, by destroying or disabling the onboard systems which employ electricity as energy.

SUMMARY

An electromagnetic grenade generally includes a standard shell with an explosively pumped flux compression generator housed inside of the standard shell casing. The standard shell casing may be configured to be launched. The explosively pumped flux compression generator includes a power source, a capacitor bank, a solenoid, a standard fuse, and an explosive. The power source is configured to store an explosive charge. Wherein, when conditions of the standard fuse are met, the power source may charge the capacitor bank with the explosive charge, and the capacitor bank may charge the solenoid with the explosive charge. Wherein, once the solenoid is charged and has electrons alternating polarities (causing an electromagnetic field to generate), the explosive detonates, thereby creating a shower of electromagnetic pulse configured to damage or disable electrical equipment. Shower as referred herein may mean an exothermic reaction of the explosive that may produce the atmospheric air and mechanical shockwave force needed to quickly convey onto the target the electromagnetic field generated by the shell.

One feature of the disclosed electromagnetic grenade may be that the shower of electromagnetic pulse created by the explosively pumped flux compression generator of the electromagnetic grenade may be configured to disable or destroy military equipment with electricity as energy for onboard systems.

Another feature of the disclosed electromagnetic grenade may be that the standard shell casing may have a standard size. In select embodiments of the disclosed electromagnetic grenade, the standard size of the standard shell casing may be a standard 40 mm cartridge case. However, the disclosure is not so limited, and the standard shell casing may be designed with other various sizes, calibers, and configurations. The standard shell casing may be configured to work with small arms, artillery shells, bombs, missiles, rockets, submunitions, or loitering munitions. In select possibly preferred embodiments, the standard shell casing may be configured to work with such small arms, artillery shells, bombs, missiles, rockets, submunitions, or loitering munitions that utilize standard 40 mm shell casings. The standard shell casing may also be configured to work with guided and unguided ordinance.

Another feature of the disclosed electromagnetic grenade may be that the standard fuse can be any type of fuse for switching on the flow from the power source. The standard fuse may be, but is not limited to, an impact fuse, an air burst fuse, a proximity fuse, a fuse designed for target penetration, the like, and/or combinations thereof.

Another feature of the disclosed electromagnetic grenade may be that the standard shell may further include an internally reflective ogive in select embodiments. The internally reflective ogive of the standard shell may be configured for tuning of an electromagnetic frequency of the electromagnetic pulse created by the electromagnetic grenade. In select embodiments, the internally reflective ogive of the standard shell may include nanomaterials. The nanomaterials of the internally reflective ogive of the standard shell may be configured to generate a charge with energy supplied by friction as the standard shell travels through an atmosphere.

In another aspect, the instant disclosure is directed toward an electromagnetic grenade in any of the various embodiments and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which:

FIG. 1 is a schematic drawing of a concept of the disclosed electromagnetic grenade according to select embodiments of the instant disclosure, the drawing is a simplified diagram of the disclosed electromagnetic grenade device showing the arrangement of components according to select embodiments;

FIG. 1A is a cross-sectional side view of the disclosed electromagnetic grenade according to select embodiments of the instant disclosure showing the construction of the shell with a 1:1 scale diagram showing the relative size of the components as well as their arrangement within a standard 40 mm grenade shell according to select embodiment of the instant disclosure; and FIG. 1B is side view of the disclosed electromagnetic grenade according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1, 1A and 1B, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1, 1A and 1B, the present of electromagnetic grenade 10 may generally include standard shell casing 12 (shell 12 or casing 12) with explosively pumped flux compression generator 14 housed inside of the standard shell casing 12. The standard shell casing 12 may be configured to be launched. The explosively pumped flux compression generator 14 may include, but is not limited to, power source 16, capacitor bank 20, solenoid 22, standard fuse 24, and explosive 26. Power source 16 may be configured to store explosive charge 18. Wherein, when conditions of standard fuse 24 are met (and the fuse is broke or switch in fuse is open), power source 16 may charge capacitor bank 20 with explosive charge 18, and capacitor bank 20 may charge solenoid 22 with explosive charge 18. Wherein, once solenoid 22 is charged and has alternating polarities of electrons 30 (causing an electromagnetic field to generate), explosive 26 may detonate, thereby creating shower of electromagnetic pulse 32 configured to damage or disable electrical equipment. Shower of electromagnetic pulse 32, as referred herein, may mean an exothermic reaction of explosive 26 that may produce the atmospheric air and mechanical shockwave force needed to quickly convey onto the target the electromagnetic field generated by shell 12.

One feature of the disclosed electromagnetic grenade 20 may be that shower of electromagnetic pulse 32 created by explosively pumped flux compression generator 14 of electromagnetic grenade 10 may be configured to disable or destroy military equipment with electricity as energy for onboard systems, including, but not limited to, unmanned ground vehicles (UGVs).

Another feature of the disclosed electromagnetic grenade 10 may be that the standard shell casing 12 may have standard size 34, as shown in FIG. 1B. In select embodiments of the disclosed electromagnetic grenade 10, standard size 34 of standard shell casing 12 may be a standard 40 mm cartridge case, as shown in FIG. 1B. However, the disclosure is not so limited, and the standard shell casing 12 may be designed with other various sizes and configurations. As such, the standard shell casing 12 may be configured to work with small arms, artillery shells, bombs, missiles, rockets, submunitions, or loitering munitions. In select possibly preferred embodiments, standard shell casing 12 may be configured to work with such small arms, artillery shells, bombs, missiles, rockets, submunitions, or loitering munitions that utilize standard 40 mm shell casings. In select embodiments, the standard shell casing 12 may also configured to work with guided and unguided ordinance.

Another feature of the disclosed electromagnetic grenade 10 may be that standard fuse 24 can be any type of fuse for switching on the flow from of electricity of explosive charge 18 from power source 16. As examples, and clearly not limited thereto, standard fuse 24 may be, but is not limited to, an impact fuse, an air burst fuse, a proximity fuse, a fuse designed for target penetration, the like, and/or combinations thereof.

Another feature of the disclosed electromagnetic grenade 10 may be that the standard shell casing 12 may further include an internally reflective ogive 36 in select embodiments. The internally reflective ogive 36 of the standard shell casing 12 may be configured for tuning of an electromagnetic frequency of the shower of electromagnetic pulse 32 created by the electromagnetic grenade 10. In select embodiments, the internally reflective ogive 36 of the standard shell casing 12 may include nanomaterials 38. The nanomaterials 38 of the internally reflective ogive 36 of the standard shell casing 12 may be configured to generate a charge with energy supplied by friction as the standard shell casing 12 travels through an atmosphere.

Another feature of the disclosed electromagnetic grenade 10 may be that it can include primer 28. Primer 28 may be configured to allow current to flow in only one direction within explosively pumped flux compression generator 14.

In another aspect, the instant disclosure is directed toward electromagnetic grenade 10 in any of the various embodiments and/or combination of embodiments shown and/or described herein.

In sum, the electromagnetic grenade 10 disclosed herein may be a purpose-built shell/round that utilizes explosively pumped flux compression generator 14 to create shower of electromagnetic pulse 32 destructive enough to disable or destroy UGVs and similar military equipment which employ electricity as energy for onboard systems. The electromagnetic grenade 10 may include standard shell casing 12 with primer 28, power source 16, capacitor bank 20, solenoid 22, and standard fuse 24. The standard shell casing 12 and standard size 34 of the shell can be changed to suit the weapon system that will employ electromagnetic grenade 10. Electromagnetic grenade 10 disclosed herein may be designed on a standard 40 mm cartridge case, as shown in the Figures, but the design can be scaled to work with smaller and larger ordinance which will include small arms, artillery shells, bombs, missiles, rockets, sub-munitions, loitering munitions, similar, the like, etc. The design of electromagnetic grenade 10 can also work with guided and unguided ordinance. Electromagnetic grenade 10 may rely on power source 16 to store enough explosive charge 18 that when the conditions of standard fuse 24 are met, power source 16 charges capacitor bank 20, and capacitor bank 20 charges the highly conductive solenoid 22. Once solenoid 22 is charged and has alternating polarities of electrons 30 (causing an electromagnetic field to generate), the explosive charge 18 is designed to detonate, thereby creating shower of electromagnetic pulse 32 on a target configured to damage or disable UGVs and similar electrical equipment. The design of electromagnetic grenade 10 may be meant to be used with a variety of fuses such as impact fuses, air burst fuses, proximity fuses and even fuses designed for target penetration. The design of electromagnetic grenade 10 may be independent of the type of power source and capacitors used, as future advancement will naturally allow for greater optimization and ruggedization of the original design. Tuning of the electromagnetic frequency is also possible if internally reflective ogive 36 is used for shell 12. Tuning to a specific frequency may increase the effectiveness of shell 12 against more specific targets. Using multiple shells 12 with internally reflective ogive 36 tuned to different frequencies may increase effectiveness against multiple and different hardened targets within a single location. The inclusion of nanomaterials 38 may provide shells 12 with ogive 36 that can generate a larger charge with the energy supplied by friction as the shell 12 travels through an atmosphere. Electromagnetic grenade 10 may be independent of advances in materials which can increase or alter its performance.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. An electromagnetic grenade comprising:

a standard shell casing configured to be launched;

an explosively pumped flux compression generator housed inside of the standard shell casing, the explosively pumped flux compression generator including:

a power source configured to store an explosive charge;

a capacitor bank;

a solenoid; and a standard fuse;

an explosive;

wherein, when conditions of the standard fuse are met, the power source charges the capacitor bank with the explosive charge, and the capacitor bank charges the solenoid with the explosive charge;

wherein, once the solenoid is charged and has an alternating polarities of electrons, the explosive detonates, thereby creating a shower of electromagnetic pulse configured to damage or disable electrical equipment.

2. The electromagnetic grenade of claim 1, wherein, the shower of electromagnetic pulse created by the explosively pumped flux compression generator of the electromagnetic grenade is configured to disable or destroy military equipment with electricity as energy for onboard systems.

3. The electromagnetic grenade of claim 1, wherein the standard shell casing has a standard size.

4. The electromagnetic grenade of claim 3, wherein, the standard size of the standard shell casing is a standard 40 mm cartridge case.

5. The electromagnetic grenade of claim 3, wherein the standard shell casing is configured to work with small arms, artillery shells, bombs, missiles, rockets, submunitions, or loitering munitions.

6. The electromagnetic grenade of claim 3, wherein the standard shell casing is configured to work with guided and unguided ordinance.

7. The electromagnetic grenade of claim 1 wherein the standard fuse is selected from a group consisting of: an impact fuse, an air burst fuse, a proximity fuse; and a fuse designed for target penetration.

8. The electromagnetic grenade of claim 1, wherein the standard shell further including an internally reflective ogive.

9. The electromagnetic grenade of claim 8, wherein the internally reflective ogive of the standard shell is configured for tuning of an electromagnetic frequency of the electromagnetic pulse created by the electromagnetic grenade.

10. The electromagnetic grenade of claim 8, wherein the internally reflective ogive of the standard shell includes nanomaterials.

11. The electromagnetic grenade of claim 10, wherein the nanomaterials of the internally reflective ogive of the standard shell are configured to generate a charge with energy supplied by friction as the standard shell travels through an atmosphere.

12. An electromagnetic grenade comprising:

a standard shell casing configured to be launched, the standard shell including an internally reflective ogive;

an explosively pumped flux compression generator housed inside of the standard shell casing, the explosively pumped flux compression generator including:

a power source configured to store an explosive charge;

a capacitor bank;

a solenoid; and a standard fuse;

an explosive;

wherein, when conditions of the standard fuse are met, the power source charges the capacitor bank with the explosive charge, and the capacitor bank charges the solenoid with the explosive charge;

wherein, once the solenoid is charged and has electrons alternating polarities, the explosive detonates, thereby creating a shower of electromagnetic pulse configured to damage or disable electrical equipment.

13. The electromagnetic grenade of claim 12, wherein the internally reflective ogive of the standard shell is configured for tuning of an electromagnetic frequency of the electromagnetic pulse created by the electromagnetic grenade.

14. The electromagnetic grenade of claim 12, wherein the internally reflective ogive of the standard shell includes nanomaterials.

15. The electromagnetic grenade of claim 14, wherein the nanomaterials of the internally reflective ogive of the standard shell are configured to generate a charge with energy supplied by friction as the standard shell travels through an atmosphere.

16. The electromagnetic grenade of claim 12, wherein, the shower of electromagnetic pulse created by the explosively pumped flux compression generator of the electromagnetic grenade is configured to disable or destroy military equipment with electricity as energy for onboard systems.

17. The electromagnetic grenade of claim 12, wherein the standard shell casing has a standard size.

18. The electromagnetic grenade of claim 17, wherein, the standard size of the standard shell casing is a standard 40 mm cartridge case.

19. An electromagnetic grenade comprising:

a standard shell casing configured to be launched, the standard shell casing has a standard size, the standard size of the standard shell casing is a standard 40 mm cartridge case, wherein the standard shell casing is configured to work with small arms, artillery shells, bombs, missiles, rockets, submunitions, or loitering munitions, wherein the standard shell casing is configured to work with guided and unguided ordinance;

an explosively pumped flux compression generator housed inside of the standard shell casing, the explosively pumped flux compression generator including:

a power source configured to store an explosive charge;

a capacitor bank;

a solenoid; and a standard fuse, the standard fuse is selected from a group consisting of: an impact fuse, an air burst fuse, a proximity fuse; and a fuse designed for target penetration;

an explosive;

wherein, when conditions of the standard fuse are met, the power source charges the capacitor bank with the explosive charge, and the capacitor bank charges the solenoid with the explosive charge;

wherein, once the solenoid is charged and has alternating polarities of electrons, the explosive detonates, thereby creating a shower of electromagnetic pulse configured to damage or disable electrical equipment;

the standard shell further including an internally reflective ogive, wherein the internally reflective ogive of the standard shell is configured for tuning of an electromagnetic frequency of the electromagnetic pulse created by the electromagnetic grenade; and wherein the internally reflective ogive of the standard shell includes nanomaterials, wherein the nanomaterials of the internally reflective ogive of the standard shell are configured to generate a charge with energy supplied by friction as the standard shell travels through an atmosphere.

20. The electromagnetic grenade of claim 19, wherein, the shower of electromagnetic pulse created by the explosively pumped flux compression generator of the electromagnetic grenade is configured to disable or destroy military equipment with electricity as energy for onboard systems.

* * * * *